US005179742A

United States Patent [19]

Oberle

[11] Patent Number: 5,179,742

[45] Date of Patent: Jan. 19, 1993

[54] PRESSURE REDUCTION MATTRESS

[75] Inventor: Joseph F. Oberle, Portage, Mich.

[73] Assignee: Stryker Corporation, Kalamazoo, Mich.

[21] Appl. No.: 786,757

[22] Filed: Nov. 1, 1991

[51] Int. Cl.[5] ..... A47C 27/22

[52] U.S. Cl. ..... 5/464; 5/481; 5/448

[58] Field of Search ..... 5/448, 464, 465, 470, 5/481, 901, 903

[56] References Cited

U.S. PATENT DOCUMENTS

| | | | |
|---|---|---|---|
| 389,420 | 9/1888 | Sutton . | |
| 934,465 | 9/1909 | Rust . | |
| 1,040,795 | 10/1912 | Skeffington . | |
| 1,276,361 | 8/1918 | Hobert . | |
| 1,548,728 | 8/1925 | Milam . | |
| 2,721,339 | 10/1955 | Johnson | 5/465 |
| 3,027,573 | 4/1962 | Bell, Jr. . | |
| 3,058,124 | 10/1962 | Sturtevant . | |
| 3,146,469 | 9/1964 | Slade . | |
| 3,451,071 | 6/1969 | Whiteley . | |
| 3,521,311 | 7/1970 | Cohen | 5/464 |
| 3,574,873 | 4/1971 | Weinstein . | |
| 3,626,526 | 12/1971 | Viel . | |
| 3,639,927 | 2/1972 | Münch . | |
| 3,742,528 | 7/1973 | Münch . | |
| 3,828,377 | 8/1974 | Fary, Sr. . | |
| 3,837,020 | 9/1974 | Bosch | 5/481 X |
| 3,846,857 | 11/1974 | Weinstock | 5/464 |
| 3,939,508 | 2/1976 | Hall et al. | 5/464 |
| 3,950,800 | 9/1976 | Garshfield | 5/470 |
| 4,120,060 | 10/1978 | Lush | 5/464 X |
| 4,269,889 | 5/1981 | Takagi | 5/448 X |
| 4,292,703 | 10/1981 | Goguen . | |
| 4,327,714 | 5/1982 | Spann . | |
| 4,628,557 | 12/1986 | Murphy . | |
| 4,668,562 | 5/1987 | Street | 5/448 X |
| 4,706,313 | 11/1987 | Murphy . | |
| 4,999,868 | 3/1991 | Kraft | 5/481 X |
| 5,031,261 | 7/1991 | Fenner, Sr. | 5/481 |
| 5,077,849 | 1/1992 | Farley | 5/481 X |

FOREIGN PATENT DOCUMENTS

| | | | |
|---|---|---|---|
| 550815 | 12/1957 | Canada . | |
| 2225229 | 3/1990 | United Kingdom | 5/481 |
| WO81/02384 | 9/1981 | World Int. Prop. O. . | |

*Primary Examiner*—Michael F. Trettel

*Attorney, Agent, or Firm*—Flynn, Thiel, Boutell & Tanis

[57] ABSTRACT

A pressure reduction mattress intended to prevent and/or treat pressure sores includes within a cover a middle layer made of a densified polyester fiber, a top layer disposed on the middle layer and having a foot support section and an upper body support section, and a bottom layer disposed beneath and adhesively bonded to the middle layer and made of high density closed cell vinyl nitrile foam, the bottom layer extending fully beneath the upper body support section of the top layer but not beneath the foot support section. The foot support section and upper body support section are each made from respective upper and lower sheets of high density open cell foam, the upper sheet of each support section being softer than the lower sheet thereof. The foot support section has a convoluted upper surface, and the upper body support section may optionally have a convoluted upper surface. The middle layer is free of connection to the top layer.

38 Claims, 3 Drawing Sheets

PRESSURE REDUCTION MATTRESS

FIELD OF THE INVENTION

This invention relates to a mattress and, more particularly, to a pressure reduction mattress intended to prevent and treat pressure sores.

BACKGROUND OF THE INVENTION

Patients confined to a bed for a long period of time frequently develop pressure sores, which are medically known as decubitus ulcers and which are commonly referred to as bedsores. These pressure sores are a debilitating and painful condition, and in extreme cases can lead to death.

One known approach for prevention and treatment involves a complex water or air flotation mattress which avoids localized pressure points. While effective, these systems are relatively complex and susceptible to failure, and are relatively expensive, and are thus not suitable for all applications.

Attempts to provide cheaper and more reliable alternatives have typically involved the use of a pad or a sheet of foam. For example, a simple foam pad has been used, with or without a convoluted upper surface. Other types of mattresses have used a foam layer on top, a layer of gel between two layers of foam, two layers of foam in which the upper layer is softer, or a foam layer with removable sections. Another approach provides a foam pad with an opening into which a gel pad is inserted. All these approaches have been generally adequate for their intended purposes, but they have not been satisfactory in all respects. For example, one aspect of foam is that, with use over time, it will tend to become permanently compressed and take a set at certain localized areas, thereby rendering it less effective. At this point, it is usually necessary to dispose of the entire mattress and replace it with a new mattress. Consequently, the useful lifetimes of these known mattresses has not been particularly long. Also, removable parts such as foam sections or gel pads can be lost or misplaced, which can render the associated mattress useless.

A further consideration is that one of the most difficult areas for reducing pressure is in the region of a patient's heels, and the majority of the existing foam-type mattresses are not fully satisfactory in preventing and treating pressure sores on a patient's heels.

Accordingly, one object of the present invention is to provide a mattress intended to prevent and/or treat pressure sores with an efficiency comparable to relatively complex air and water floatation systems, but which is significantly cheaper than the flotation systems.

A further object is to provide such a mattress in which a majority of the components of the mattress have a relatively long useful lifetime.

A further object is to provide such a mattress which is highly effective with respect to pressure sores in the region of the heels of a patient.

SUMMARY OF THE INVENTION

The objects and purposes of the invention, including those set forth above, are met according to one form of the invention by providing a mattress having a top layer which is made of a resilient material and which includes a foot support section and an upper body support section, the foot support section having a lower portion and having thereabove an upper portion which is softer than the lower portion, and the upper body support section having a lower portion and having thereabove an upper portion which is softer than the lower portion. The upper portion of the foot support section is thicker than the lower portion thereof, and the lower portion of the upper body support section is thicker than the upper portion thereof, the upper portion of the foot support section being thicker than the upper portion of the upper body support section.

According to a different form of the invention, the mattress includes a fiber layer having disposed thereon a top layer made of a foam material.

BRIEF DESCRIPTION OF THE DRAWINGS

A preferred embodiment of the invention is described in detail hereinafter with reference to the accompanying drawings, in which.

DETAILED DESCRIPTION

Figure 1:
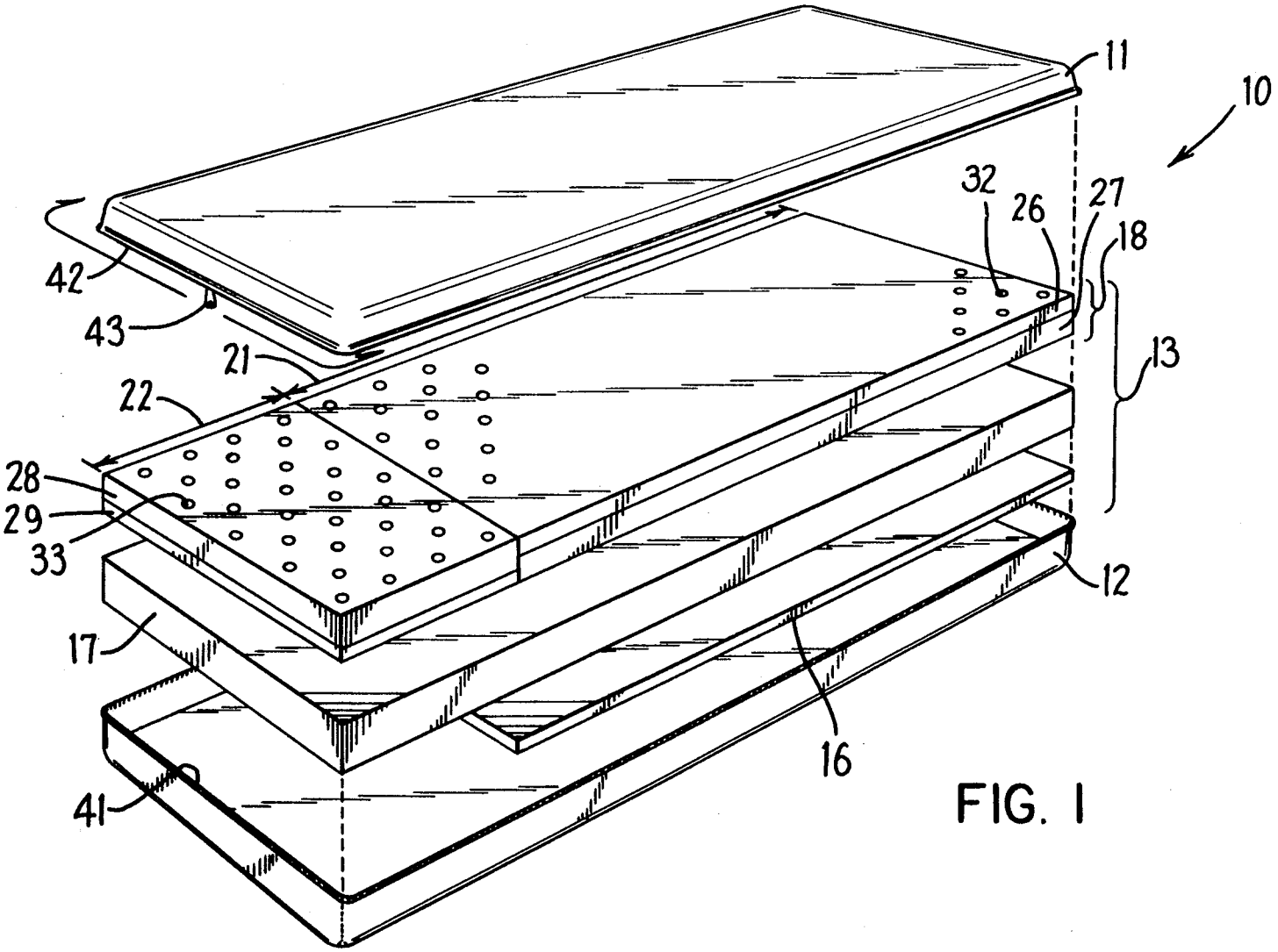
FIG. 1 is an exploded perspective view of a mattress embodying the present invention.

FIG. 1 shows a mattress 10 which embodies the present invention, and which includes a top portion 11 and a bottom portion 12 of a cover, and an internal core 13. The internal core 13 includes a bottom layer 16, a middle layer 17, and a top layer 18.

The top layer 18 has an upper body support section 21, and a foot support section 22. The foot support section 22 is provided to support the feet of a patient lying on the mattress, and the upper body support section 21 is provided to support the rest of the patient, namely from the patient's head down to about the patient's knees.

The top layer 18 is made of a conventional and commercially available high density open cell foam. In particular, the upper body support section 21 of layer 18 includes an upper sheet 26 and lower sheet 27 each of high density open cell foam, the upper sheet 26 having a lower ILD (indentation load deflection) value than the lower sheet 27. The upper sheet 26 thus is somewhat softer than the lower sheet 27. The upper sheet 26 is secured to the lower sheet 27 by an adhesive, which may be any conventional and commercially available adhesive suitable for use with open cell foam materials. It should be noted that the thickness of the upper sheet 26 is approximately twice the thickness of the lower sheet 27.

In a similar manner, the foot support section 22 of the top layer 18 includes an upper sheet 28 and lower sheet 29 of high density open cell foam, the upper sheet 28 having a lower ILD value than the lower sheet 29 and being approximately twice as thick as the lower sheet 29. The sheets 28 and 29 are secured to each other by a conventional and commercially available adhesive, and foot support section 22 is fixedly secured to the upper body support section 21 by the same adhesive. It will be noted that the combined thickness of sheets 26 and 27 of upper body support section 21 is equal to the combined thickness of sheets 28 and 29 of foot support section 22. Upper sheets 26 and 28 are preferably made of the same foam material and have the same ILD value, and lower sheets 27 and 29 are preferably made of the same foam material and have the same ILD value. The ILD value for the upper sheets should be in the range of 5–20 lbs, and for the lower sheet should be in the range of 25–60 lbs. In the preferred embodiment, upper sheets 26 and 28 have an ILD value of 11–15 lbs, and lower sheets 27 and 29 have an ILD value of 39–45 lbs. Suitable sheets of foam material for the top layer 18 are available as IRIS ® 10,000 series foam from E.R. Carpenter Company, Inc., Richmond, Virginia.

The upper sheet 28 of the foot support section 22 has a convoluted upper surface, in particular through the provision of a plurality of spaced, approximately semi-spherical recesses 33 which are arranged in rows and columns. A similar convoluted surface may be provided on the upper sheet 26 of the upper body support section 21 by a plurality of similar recesses 32. However, in situations where the mattress 10 is intended to be used on an X-ray table such that X-rays will pass through the mattress 10 before reaching the X-ray film, the recesses 32 are preferably omitted so that the upper sheet 26 is not convoluted, in order to ensure that a pattern of convolutions is not transferred to the X-ray film. Thus, in the context of the X-ray situation, the top surface of the foot support section 22 would be convoluted but the top surface of upper body support section 21 would not be convoluted, whereas for other applications sections 21 and 22 would both preferably have top surfaces which are convoluted.

The middle layer 17 is a sheet of a conventional and commercially available densified polyester fiber, a suitable source for which is Gate City Bedding, Inc., Jacksonville, Florida. The densified polyester fiber has a high degree of memory when compressed, or in other words has a strong tendency to return to its original state and does not tend to become permanently compressed over time as foam does. In fact, it may possibly tend to expand slightly over time. Unlike foam, the middle layer 17 of densified polyester fiber can be washed and reused. Also, where foam will tend to compress in a localized area when pressure is applied to that area, the polyester fibers in the middle layer 17 will tend to transfer forces laterally so that downward pressure in a local area will be distributed reasonably uniformly within a region which surrounds and includes the local are where the pressure is applied. The layer 17 in the preferred embodiment has an ILD at 25% compression in the range of 15–35 lbs, and preferably 25 lbs, an ILD at 65% compression in the range of 50–70 lbs, and preferably 60 lbs, and a density in the range of 2–4 oz per board foot, and preferably 2.7 oz per board foot.

Middle layer 17 is not secured in any manner to the top layer 18. They are held in place with respect to each other by the cover which includes portions 11 and 12, as discussed later.

Figure 2:
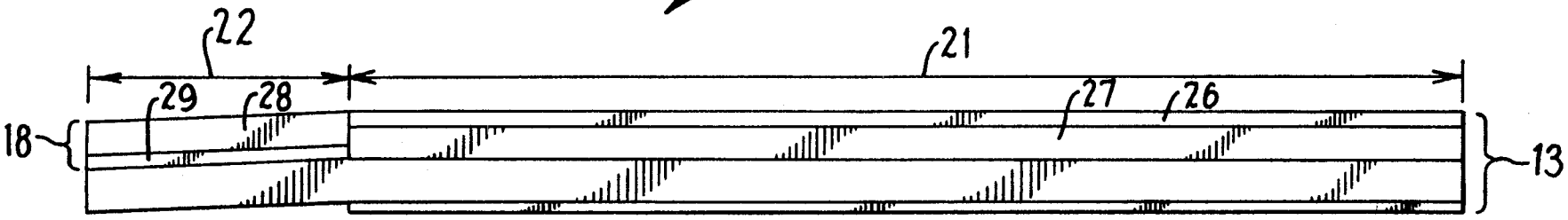
FIG. 2 is an elevational side view of an internal core of the mattress FIG. 1.

The bottom layer 16 is a conventional and commercially available high density closed cell vinyl nitrile foam having a high ILD value. A sheet of foam suitable for use as the bottom layer can be obtained from Grand Rapids Foam & Trim of Grand Rapids, Michigan, and has an ILD value of in the range of 90 to 150 lbs, and preferably 110–130 lbs. The density is in the range of 3–8 lbs/ft$^3$, and in the preferred embodiment is 4.5–6.5 lbs/ft$^3$. The length of the bottom layer 16 is shorter than the lengths of the middle layer 17 and top layer 18, and in the preferred embodiment is about 15 inches shorter. In particular, the length of the bottom layer 16 is the same as the length of the upper body support section 21 of top layer 18, and the bottom layer 16 is aligned with the upper body support section 21 directly below it. Thus, as shown in FIG. 2, since the bottom layer 16 does not extend beneath the foot support section 22, the foot support section 22 and the portion of middle layer 17 beneath it each extend outwardly and downwardly away from the remainder of the mattress at a small angle. The bottom layer 16 is fixedly secured to the middle layer 17 by a suitable adhesive, which may be any conventional and commercially available adhesive commonly used for materials of this type. In a variation of the preferred embodiment of FIG. 1, the bottom layer 16 is omitted. In another variation, the bottom layer extends the full length of the mattress. In other respects, each of these variations is identical to the embodiment of FIG. 1.

The top and bottom portions 11 and 12 of the cover are made from conventional materials. In the preferred embodiment, bottom portion 12 is made from a vinyl sheet material available as Staph Chek Vinyl from Herculite Products, Inc. of York, Pennsylvania. The top portion 11 is made from a sheet of urethane-backed nylon material available from Brookwood Industries of New York, New York. The bottom portion 12 of the cover has a rectangular bottom wall portion and four upstanding sidewall portions, as well as a zipper portion 41 which extends the full perimeter of the cover portion 12 along the upper ends of the four sidewalls. The top cover portion 11 is approximately rectangular, and has a zipper portion 42 which extends along its full periphery and which can be releasably coupled to the zipper portion 41 on bottom cover portion 12. The zipper portion 42 has a conventional pull tab 43 which is used to engage and release the zipper.

Figure 3:
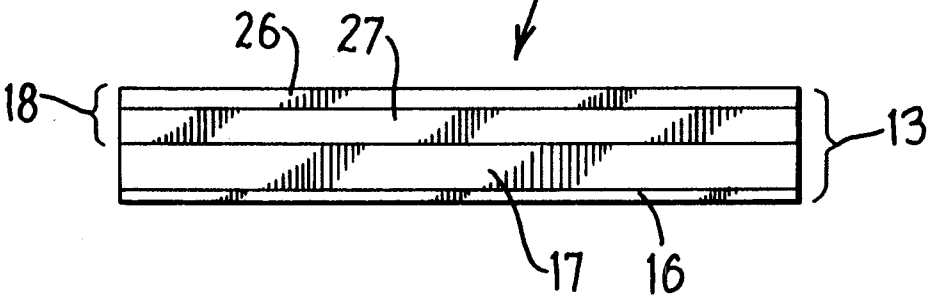
FIG. 3 is an elevational end view of the internal core of the mattress of FIG. 1.
Figure 4:
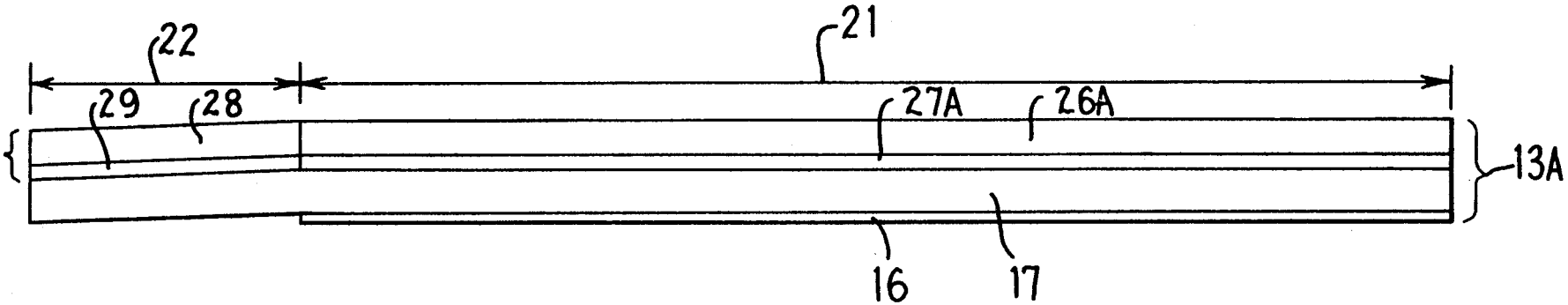
FIG. 4 is a view similar to FIG. 2 of an alternative embodiment of the mattress of FIG. 1.
Figure 6:
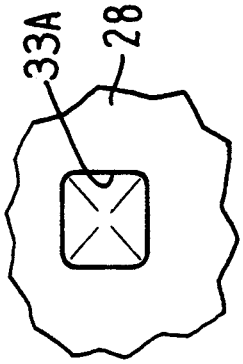
FIG. 6 is a fragmentary top view of the recess of FIG. 5.
Figure 5:
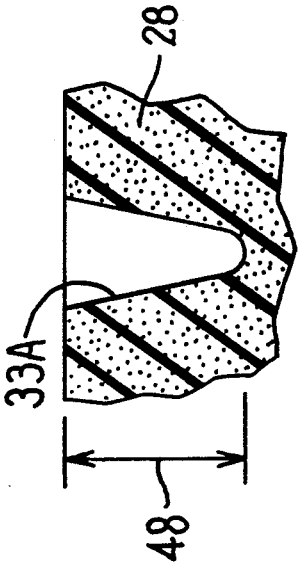
FIG. 5 is a fragmentary sectional side view of a recess provided in an upper surface of the mattress of FIG. 4.

FIGS. 4–6 show an internal core 13A which is an alternative embodiment of the internal core shown in FIGS. 1–3. Equivalent parts are designated with the same reference numerals, and only the differences are described in detail here.

In particular, in the top layer 18A of the internal core 13A, the sheets 28 and 29 of the foot support section 22 are the same, but the sheets 26A and 27A of the upper body support section 21 have different thicknesses than the corresponding sheets 26 and 27 of the internal core 13 of FIGS. 1–3. In particular, in the embodiment of FIG. 4, the upper sheet 26A has the same thickness as the upper sheet 28, and the lower sheet 27A has the same thickness as the sheet 29. The sheets 26A and 27A are respectively made of the same materials as sheets 26 and 27.

A further difference in the embodiment of FIGS. 4–6 is that the recesses provided in the top surfaces of the sheets 26A and 28 are of a different shape than in the embodiments of FIGS. 1–3. In particular, as shown in FIGS. 5 and 6, each recess 33A in sheet 28 has approximately the shape of an inverted four-sided pyramid with a rounded point and with an approximately square cross section when viewed in a top view (FIG. 6). The recesses 33A have a depth which is shown at 48 in FIG. 5. As in the previously-described embodiment, recesses are optional in the sheet 26A, but are preferably present in the sheet 28. When present in both sheets, the recesses 33A in the sheet 28 are preferably almost twice as deep as those in the sheet 26A, and in the preferred embodiment are respectively 1¾ inch and 1 inch, the size of the approximately square opening at the upper end of each recess being about the same in each sheet. In the preferred embodiment, the upper sheets 26A and 28 are 2 inches thick and the lower sheets 27A and 29 are 1 inch thick.

In use, and as mentioned above, the middle layer 17 (FIGS. 1–3) of a densified polyester fiber tends to distribute forces laterally, so that a force applied to a local area is distributed laterally to a somewhat larger region which includes the local area. The top layer 18 is provided to closely conform to the contours of the human body, and middle layer 17 serves as a support system for the top layer 18. In the top layer 17, the soft foam upper sheet 28 of foot support section 22 is thicker than the soft foam upper sheet 26 of upper body support section 21, which permits the heels of a patient to sink in further in the foot support section 22 than would be possible in the upper body support section 21, resulting in distribution of weight to the patient's calves, but not in any concentrated area. This is an important feature of the mattress 10, because as mentioned above a very difficult spot for reducing pressure sores is at the patient's heels. The bottom layer 16 of high density closed cell foam has as its primary purpose to prevent an unusually heavy patient from "bottoming out" against an upwardly facing surface on which the mattress is resting. Because the bottom layer 16 is shorter than the other layers and does not extend beneath the foot support section 22, the foot support section 22 and the portion of the middle layer 17 below it are inclined to extend outwardly and downwardly at a small angle as shown in FIG. 2, so that the top surface of foot support section 22 drops away from the level of the top surface of upper body support section 21. This also helps to reduce pressure against the heels of the patient.

Thus, the top layer 18 conforms to the shape of the patient, the middle layer 17 provides support, and the bottom layer 16 prevents a heavy patient from bottoming out.

As already mentioned, foam has a tendency over time to permanently compress in areas where pressure is applied, which tends to defeat attempts to eliminate bedsores. In contrast, the middle layer 17 of densified polyester fiber in the mattress 10 according to this invention remains relatively springy and resilient throughout its lifetime and does not tend to take a "set". In time, since the top layer 18 of the mattress 10 is made of foam, the top layer 18 will have portions which may become permanently compressed. If this happens, the zipper 41–43 is opened so that the cover sections 11 and 12 can be separated, and then the existing top layer 18 of foam is replaced with a new identical top layer 18 of foam. If necessary, the middle layer 17 and attached bottom layer 16 can be removed and replaced, although this should be unnecessary during the normal useful lifetime of the mattress 10. If desired, the nylon cover portion 11 can be washed and dried. Thereafter, the cover portions 11 and 12 are reattached to each other using the zipper 41–43. As mentioned above, the top layer 18 is intentionally not adhesively secured to any other component, and the specific reason for this is to permit rapid and easy replacement of the top layer 18. The materials of the middle layer 17 and top layer 18 do, however, have an inherent tendency to cling to each other in a manner resisting lateral relative sliding movement therebetween and thus maintain them in proper alignment during use, but they can nevertheless be easily manually separated when the cover portions have been unzipped. By replacing just the top layer 18, the mattress 10 can be quickly restored to its original capability for resilience and support at minimal expense, thus permitting the other mattress components, which constitute the majority of the mattress, to have an unusually long useful lifetime. This is in contrast to many conventional mattresses where all parts are interconnected and, when a foam layer takes a permanent set, the entire mattress must be thrown away and replaced with an entirely new mattress.

Although a single preferred embodiment of the invention has been illustrated and described in detail for illustrative purposes, it will be recognized that there are variations or modifications of the disclosed mattress, including the rearrangement of parts, which lie within the scope of the present invention.

The embodiments of the invention in which an exclusive properly or privilege is claimed are defined as follows:

1. A mattress, comprising a top layer which is made of a resilient material and which includes a foot support section and an upper body support section, said foot support section having a lower portion and having thereabove an upper portion which is softer than said lower portion, and said upper body support portion having a lower portion and having thereabove an upper portion which is softer than said lower portion, said upper portion of said foot support section being thicker than said lower portion thereof, and said lower portion of said upper body support section being thicker than said upper portion thereof, said upper portion of said foot support section being thicker than said upper portion of said upper body support section.

2. A mattress of claim 1, wherein said upper and lower portions of said foot support section are respective sheets of foam material adhesively secured to each other, and said upper and lower sheets of said upper body support section are respective sheets of foam material adhesively secured to each other, said sheets which are said upper portions of said foot support section and upper body support section having respective ILD values which are substantially the same, and said sheets which are said lower portions of said foot support section and upper body support section having respective ILD values which are substantially the same.

3. A mattress of claim 2, wherein said foot support section of said top layer has a convoluted upper surface.

4. A mattress of claim 3, wherein said upper body support section of said top layer has a convoluted upper surface.

5. A mattress of claim 2, including a fiber layer of substantially uniform thickness disposed immediately below said top layer, said foot support section and said upper body support section of said top layer being disposed on respective portions of said fiber layer.

6. A mattress of claim 5, including a bottom layer which is made of a high density closed cell foam, which is disposed against said fiber layer on a side thereof remote from said top layer, and which extends beneath said upper body support portion but not said foot support portion thereof.

7. A mattress of claim 6, including a cover having in an interior thereof said top layer, fiber layer and bottom layer.

8. A mattress, comprising: a top layer which is made of a resilient material and which includes a foot support section and an upper body support section, said foot support section having a lower portion and having thereabove an upper portion which is softer than said lower portion, and said upper body support portion having a lower portion and having thereabove an upper portion which is softer than said lower portion, said upper portion of said foot support section being thicker than said lower portion thereof, and said upper portion of said upper body support section being thicker than said lower portion thereof; and a densified fiber layer of substantially uniform thickness disposed immediately below said top layer, said foot support section and said upper body support section of said top layer being disposed on respective portions of said fiber layer.

9. A mattress of claim 8, wherein said upper portions of said foot support section and said upper body support section have substantially equal thicknesses, and said lower portions of said foot support section and said upper body support section have substantially equal thicknesses.

10. A mattress of claim 9, wherein said upper and lower portions of said foot support section are respective sheets of foam material adhesively secured to each other, and said upper and lower sheets of said upper body support section are respective sheets of foam material adhesively secured to each other, said sheets which are said upper portions of said foot support section and upper body support section having respective ILD values which are substantially the same, and said sheets which are said lower portions of said foot support section and upper body support section having respective ILD values which are substantially the same.

11. A mattress of claim 10, wherein said foot support section of said top layer has a convoluted upper surface.

12. A mattress of claim 11, wherein said upper body support section of said top layer has a convoluted upper surface.

13. A mattress of claim 10, including a bottom layer which is made of a high density closed cell foam, which is disposed against said fiber layer on a side thereof remote from said top layer, and which extends beneath said upper body support portion but not said foot support portion thereof.

14. A mattress of claim 13, including a cover having in an interior thereof said top layer, fiber layer and bottom layer.

15. A mattress of claim 13, wherein said upper portions of said foot support section and said upper body support section each have an ILD value in the range of 5 to 20 lbs, wherein said lower portions of said foot support section and said upper body support section each have an ILD value in the range of 25 to 60 lbs, wherein said bottom layer has an ILD value in the range of 90 to 150 lbs, and wherein said densified fiber layer has an ILD at 25% compression in the range of 15 to 35 lbs and an ILD at 65% compression in the range of 50 to 70 lbs.

16. A mattress of claim 8, wherein each said portion of said top layer is made of a foam material, wherein said upper portions of said foot support section and said upper body support section each have an ILD value in the range of 5 to 20 lbs, and wherein said lower portions of said foot support section and said upper body support section each have an ILD value in the range of 25 to 60 lbs.

17. A mattress of claim 16, wherein said densified fiber layer has an ILD at 25% compression in the range of 15 to 35 lbs and an ILD at 65% compression in the range of 50 to 70 lbs.

18. A mattress of claim 8, wherein said top layer is removably supported on said densified fiber layer.

19. A mattress of claim 18, including a cover having therein said top layer and said densified fiber layer.

20. A mattress, comprising: a fiber layer which is a sheet of fiber material, a top layer made of a resilient material and disposed on said fiber layer, and a further layer made of a foam material and provided immediately beneath said fiber layer, wherein said top layer has a foot support section and an upper body support section, said further foam layer extending beneath said upper body support section but not said foot support section.

21. A mattress of claim 20, wherein said top layer has an upper portion and a lower portion, said upper portion being softer than said lower portion.

22. A mattress of claim 20, wherein said fiber layer is a sheet of a densified polyester fiber material.

23. A mattress of claim 20, wherein said foot support section extends downwardly at a small incline in a direction away from said upper body support portion.

24. A mattress, comprising: a fiber layer which is a sheet of fiber material, and a top layer made of a resilient material and disposed on said upper layer, wherein said top layer has an upper portion and a lower portion, said upper portion being softer than said lower portion, wherein said top layer includes a foot support section and an upper body support section, wherein in said foot support section said upper portion of said top layer is thicker than said lower portion thereof, and wherein in said upper body support section said lower portion of said top layer is thicker than said upper portion thereof.

25. A mattress of claim 24, wherein said foot support section of said top layer includes first and second sheets of foam material which are respectively said upper and lower portions thereof, and said upper body support section includes third and fourth sheets of foam material which are respectively said upper and lower portions thereof.

26. A mattress of claim 24, wherein said foot support section of said top layer has a convoluted upper surface.

27. A mattress of claim 26, wherein said upper body support section of said top layer has a convoluted upper surface.

28. A mattress of claim 24, including a further layer made of a foam material and disposed against said fiber layer on a side thereof remote from said top layer.

29. A mattress of claim 28, wherein said further layer extends beneath said upper body support section but not said foot support section.

30. A mattress of claim 29, including a cover having therein said top layer, fiber layer and bottom layer.

31. A mattress of claim 24, wherein said fiber layer is a sheet of a densified polyester fiber material.

32. A mattress, comprising: a top layer which is made of a resilient material and includes a foot support section and an upper body support section, said foot support section of said top layer having a convoluted upper surface and said upper body support section of said top layer having an upper surface which is free of convolutions; wherein said convoluted upper surface is defined by a plurality of recesses in the upper surface; and wherein said recesses in said foot support section are each of substantially uniform size and shape, and each have approximately the shape of an inverted, four-sided pyramid.

33. A mattress of claim 32, including a fiber layer which is a sheet of a densified polyester fiber material, said top layer being provided on said fiber layer.

34. A mattress, comprising: a top layer which is made of a resilient material and includes a foot support section and an upper body support section, said foot support section of said top layer having a convoluted upper surface and said upper body support section of said top layer having an upper surface which is free of convolutions; wherein said convoluted upper surface is defined by a plurality of recesses in the upper surface; wherein said foot support section has a lower portion and has thereabove an upper portion which is softer than said lower portion thereof, and said upper body support portion has a lower portion and has thereabove an upper portion which is softer than said lower portion thereof; and wherein said upper portion of said foot support section is thicker than said lower portion thereof, and said upper portion of said upper body support section is thicker than said lower portion thereof.

35. A mattress, comprising: a top layer which is made of a resilient material and includes a foot support section and an upper body support section, said foot support section and said upper body support section of said top layer each having a convoluted upper surface, said upper surface of said foot support section being substantially more convoluted than said upper surface of said upper body support section; wherein each said convoluted upper surface is defined by a plurality of recesses in the upper surface, said recesses in said foot support section being substantially deeper than said recesses in said upper body support section; and wherein said recesses in said foot support section and said upper body support section each have at an upper end thereof an opening, said openings in said foot support section and said upper body support section all having a substantially uniform cross-sectional size and shape.

36. A mattress of claim 35, wherein each of said recesses in said foot support section and said upper body support section has approximately the shape of an inverted, four-sided pyramid.

37. A mattress of claim 35 including a fiber layer which is a sheet of a densified polyester fiber material, said top layer being provided on said fiber layer.

38. A mattress, comprising: a top layer which is made of a resilient material and includes a foot support section and an upper body support section, said foot support section and said upper body support section of said top layer each having a convoluted upper surface, said upper surface of said foot support section being substantially more convoluted than said upper surface of said upper body support section; wherein each said convoluted upper surface is defined by a plurality of recesses in the upper surface, said recesses in said foot support section being substantially deeper than said recesses in said upper body support section; wherein said foot support section has a lower portion and has thereabove an upper portion which is softer than said lower portion thereof, and said upper body support portion has a lower portion and has thereabove an upper portion which is softer than said lower portion thereof; and wherein said upper portion of said foot support section is thicker than said lower portion thereof, and said upper portion of said upper body support section is thicker than said lower portion thereof.

* * * * *

UNITED STATES PATENT AND TRADEMARK OFFICE

CERTIFICATE OF CORRECTION

PATENT NO. : 5 179 742

DATED : January 19, 1993

INVENTOR(S) : Joseph F. OBERLE

It is certified that error appears in the above-identified patent and that said Letters Patent is hereby corrected as shown below:

Column 8, line 28; change "upper" to ---fiber---.

Signed and Sealed this

Ninth Day of November, 1993

*Attest:*

*Attesting Officer*

BRUCE LEHMAN

*Commissioner of Patents and Trademarks*